US007507294B2

(12) United States Patent
Trevisan

(10) Patent No.: US 7,507,294 B2
(45) Date of Patent: Mar. 24, 2009

(54) METHOD AND APPARATUS FOR POWDER PAINTING A MANUFACTURED ARTICLE

(76) Inventor: Silvio Maria Trevisan, Via Mantovana 103, Verona (IT)

( * ) Notice: Subject to any disclaimer, the term of this patent is extended or adjusted under 35 U.S.C. 154(b) by 285 days.

(21) Appl. No.: 10/555,864

(22) PCT Filed: Jun. 23, 2003

(86) PCT No.: PCT/EP03/06598

§ 371 (c)(1),
(2), (4) Date: Nov. 4, 2005

(87) PCT Pub. No.: WO2004/098786

PCT Pub. Date: Nov. 18, 2004

(65) Prior Publication Data

US 2006/0280863 A1 Dec. 14, 2006

(30) Foreign Application Priority Data

May 7, 2003 (IT) ..... MI2003A0918

(51) Int. Cl.
*B05C 5/02* (2006.01)

(52) U.S. Cl. ..... 118/66; 118/663; 118/712; 118/308

(58) Field of Classification Search ..... 118/66, 118/663, 712, 308; 427/201, 359, 372.2, 427/428.11, 429
See application file for complete search history.

(56) References Cited

U.S. PATENT DOCUMENTS

| | | | | |
|---|---|---|---|---|
| 4,048,885 | A | 9/1977 | Miyakita et al. | |
| 6,350,491 | B1 * | 2/2002 | Williams | 427/384 |
| 6,767,406 | B2 * | 7/2004 | Vitale | 118/421 |

FOREIGN PATENT DOCUMENTS

| | | |
|---|---|---|
| AT | 1 274 863 | 8/1968 |
| BE | 735092 | 6/1967 |
| EP | 1 188 488 | 3/2002 |
| WO | WO 02/11897 | 2/2002 |

* cited by examiner

*Primary Examiner*—Laura Edwards
(74) *Attorney, Agent, or Firm*—Andrew Wilford

(57) ABSTRACT

An article to be powder painted is suspended from an overhead conveyor and moved continuously along a horizontal transport path through at least one first and at least one second painting stations and respective first and second baking stations. Downstream of the second painting station(s) the article is brushed or rolled to impart texture to the second coat of paint, which differs in some respect from the first coat applied in the first station. The article is suspended so it can rotate about a vertical axis and is rotated through 90° between succeeding painting stations.

11 Claims, 3 Drawing Sheets

METHOD AND APPARATUS FOR POWDER PAINTING A MANUFACTURED ARTICLE

CROSS REFERENCE TO RELATED APPLICATIONS

This application is the US national phase of PCT application PCT/EP2003/006598, filed 23 Jun. 2003, published 18 Nov. 2004 as WO 2004/098786, and claiming the priority of Italian patent application MI2003A000918 itself filed 7 May 2003, whose entire disclosures are herewith incorporated by reference.

FIELD OF THE INVENTION

The present invention relates to a method and apparatus for the application of powder painting on a manufactured article. Powder painting is currently used very widely in the field of surface decoration to imitate a wood finish on metal sections normally destined for manufacturing window and door frames.

The painting method traditionally used comprises a first step for the application of a first layer of base coat, followed by a step for fixing said layer by means of partial paint polymerization, a successive step comprising the application of a second decorative layer of paint, and a final step comprising the baking method to complete the polymerization of the two layers of paint.

Traditional painting methods present certain drawbacks that restrict wide scale industrial application, above all in the application of the decorative layer that often requires control by an experienced and expert person.

Because of the need for qualified personnel, this traditional painting method is not very productive.

Other painting methods using automated systems are well-known, but the final results are not satisfactory because the reproduction of the required decorative appearance is not acceptable.

OBJECTS OF THE INVENTION

Therefore the technical object of the present invention is to provide a powder-painting method and application equipment for manufactured articles that will eliminate the technical drawbacks encountered in prior art.

In the context of this technical task, one object of the invention is to realise a completely automated method and application equipment for powder painting.

A further object of the invention is to provide a powder-painting method and application equipment able to provide an imitation wood finish that reproduces the required decorative pattern perfectly on the manufactured article.

Yet another object of the present invention is to provide a powder-painting method and application equipment that will optimize productive cyclic times eliminating idle time.

Last but not least object of the invention is to provide a powder-painting method and application equipment that are economical, efficient, and easy to use.

SUMMARY OF THE INVENTION

The technical task as well as these and other objects according to the present invention are achieved by a powder-painting method applied to at least one manufactured article comprising the known steps of application of a first layer of powder paint, the fixing of the first paint layer, the application of a second layer of powder paint in a color, tone and/or properties that are different from those of the first layer, and the final baking of the first and at least second layers of paint, the rolling and/or brushing of the manufactured article conferring the required decoration thereon The method of this invention provides for the continuous forward movement of the article, passing at least first painting means during the painting step, and respective first rolling and/or brushing means during the rolling and/or brushing steps, in a corresponding closed cyclic passage comprising the travel of the manufactured article for at least a first following section of the manufactured article during which it is subject to relative transfer between said at least first painting means and rolling and/or brushing means respectively and the manufactured article.

BRIEF DESCRIPTION OF THE DRAWING

Further characteristics and advantages of the invention will be more evident in the description of a preferred but not limiting embodiment of the powder-painting method and application equipment according to the invention illustrated as an example but in no way limitative, in the appended drawings wherein.

SPECIFIC DESCRIPTION

Figure 1:
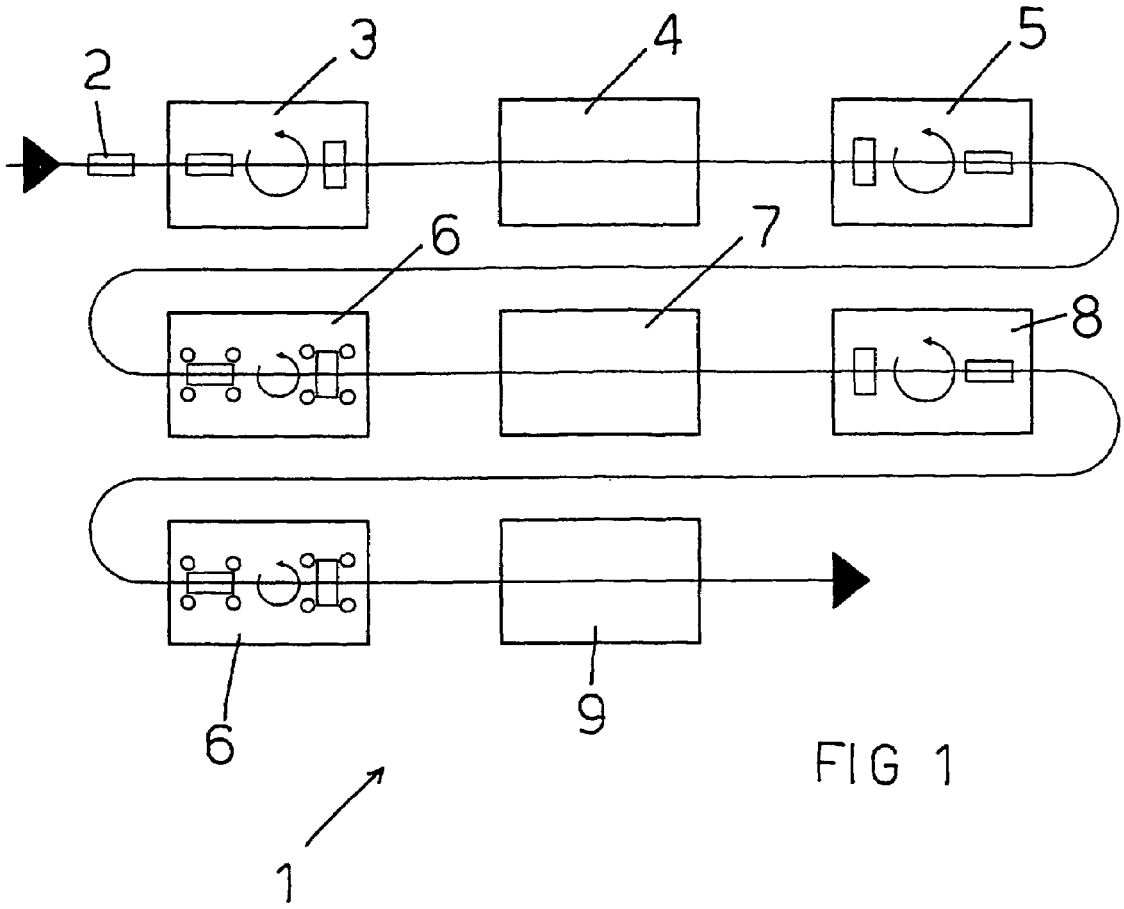
FIG. 1 shows a schematic view of the various powder-painting method steps according to the present invention.
Figure 4:
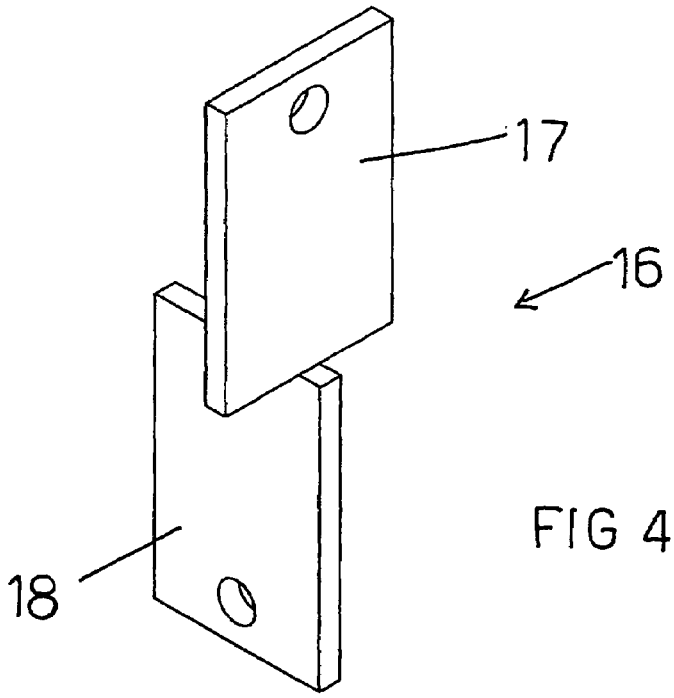
FIG. 4 shows an enlargement of the support element of an envisaged manufactured article applied to an overhead transport conveyor according to the present invention.
Figure 2:
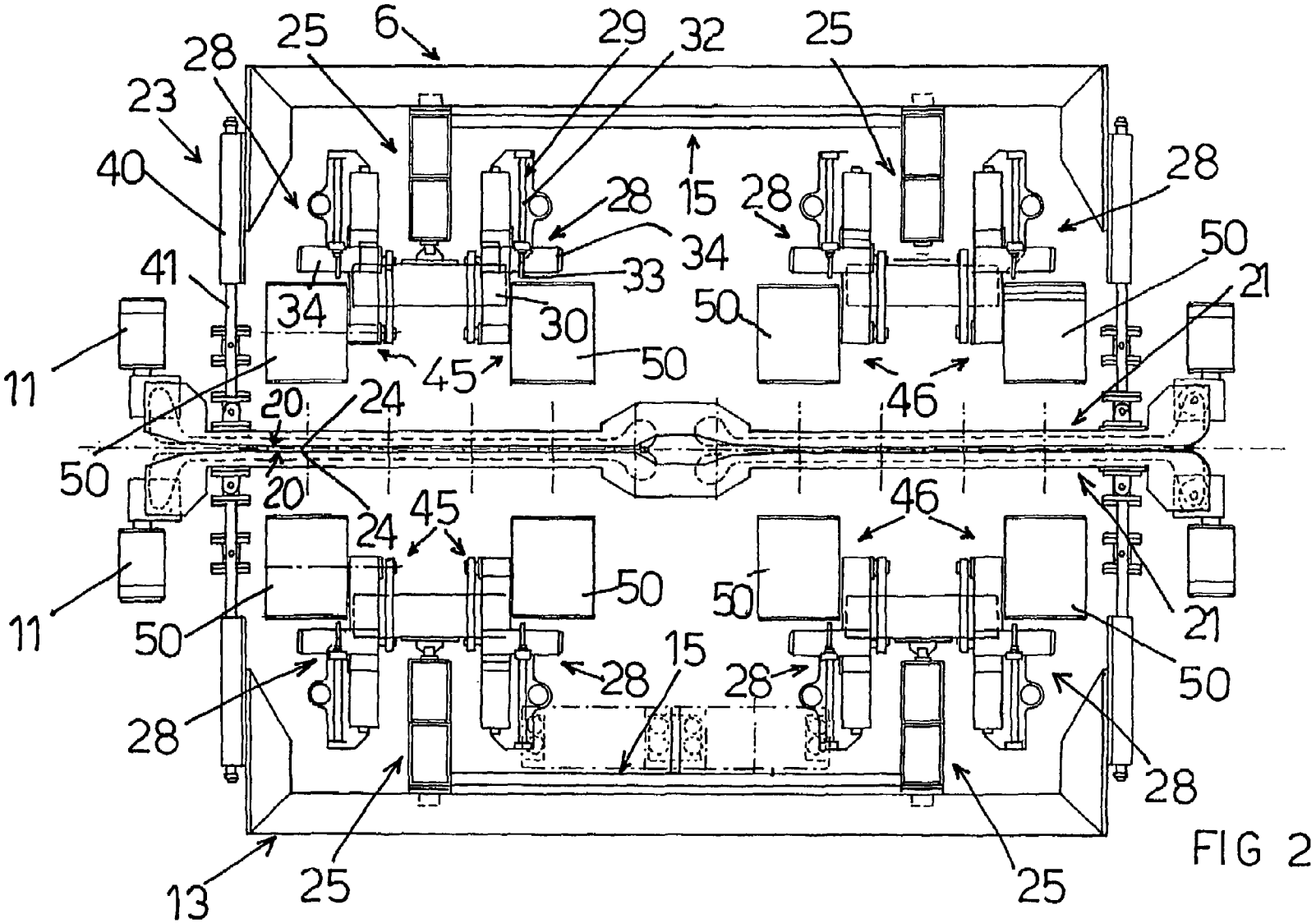
FIG. 2 shows a plan view of the rolling and/or brushing center of the present invention in idle position.
Figure 3:
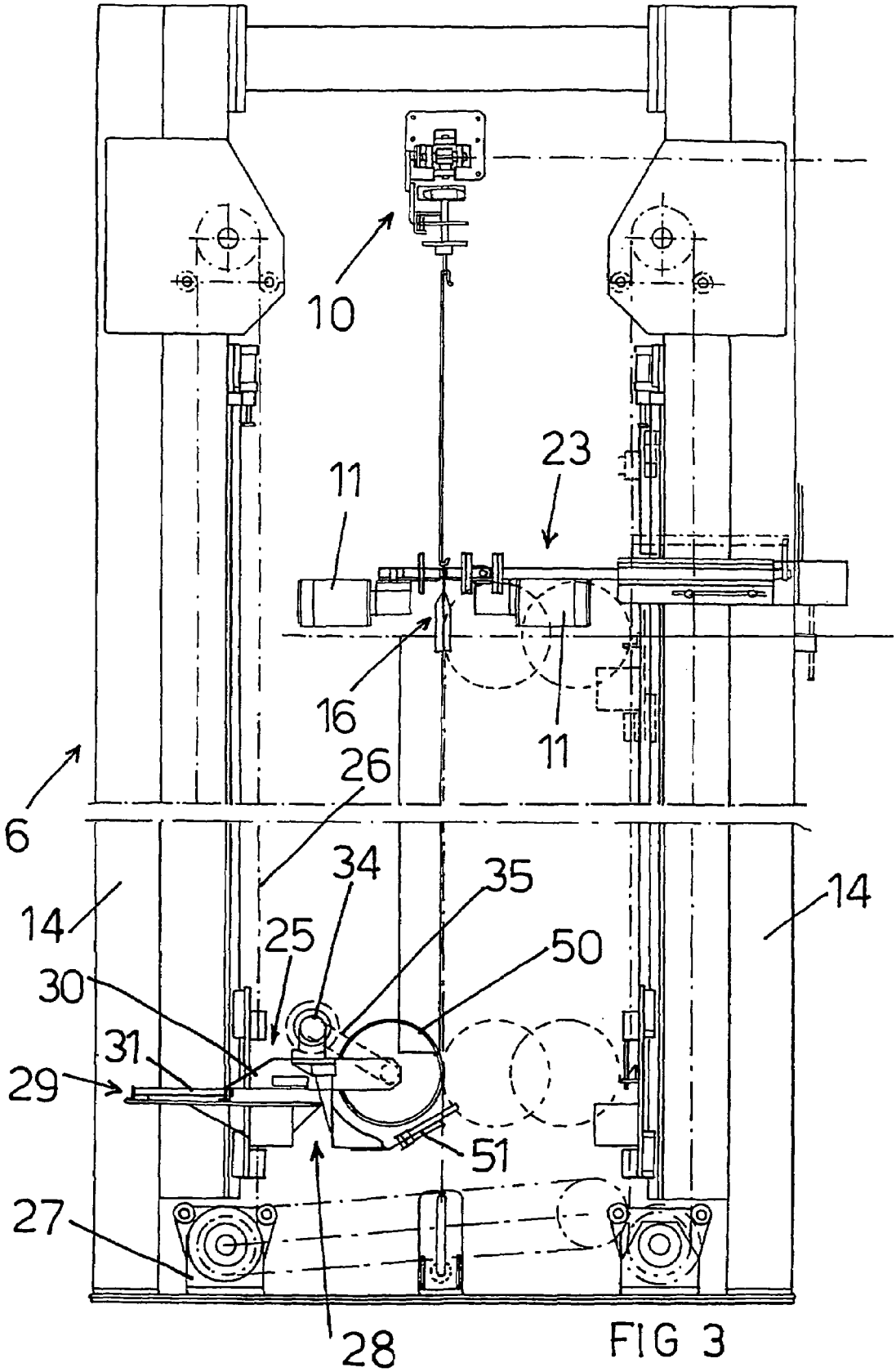
FIG. 3 shows a side view in elevation of the rolling and brushing center shown in FIG. 2 with a single left hand side roller/brush unit only in working position, where the dotted lines show the working and idle positions of the right hand side roller/brush unit.

In reference to FIG. 1, an automated powder-painting apparatus for one or more manufactured articles 2 is shown, identified throughout by the reference numeral 1.

The method carried out by the apparatus 1 is preferably developed in sequence through a first painting center 3, in which a first base coat is applied to each manufactured article 2, a fixing station 4 comprising an oven (not illustrated) for fixing or partial polymerization of the base coat, a second painting center 5 where each manufactured article 2 is coated with a second layer of paint with a color, tone and/or properties different from the first base coat, a rolling and/or brushing device 6, used exclusively for brushing operations to confer a uniform variegated aspect, a second fixing station 7 for fixing the second coat of paint, at least a third painting center 8 where each article 9 is coated with a third layer of paint, a second brushing and/or rolling equipment 6 used exclusively for brushing operations to provide each article with the required decorative finish, and a final baking station 9 adapted to complete the polymerization process of the three paint layers applied to each manufactured article 2.

In reference to the other remaining figures, each manufactured article 2 is transported by an overhead conveyor line 10 controlled by driving means, such as a motor 11, adapted to transport each manufactured article 2 in continuous mode through the successive steps of the painting process.

The illustrated apparatus 1 is vertical type, but the inventive concept of the present invention can be just as easily applied to horizontal painting apparatus.

In the apparatus 1 each manufactured article is therefore suspended vertically and travels in a horizontal direction.

Each manufactured article 2 is typically a metal section with four sides in the form of two pairs of sides opposite each other, therefore the treatment in each painting center and each roller and/or brush unit requires two separate positions between which a rotation unit is positioned (not shown) adapted to rotate each manufactured article 2 by 90°. so that one pair of opposite sides of each article 2 is treated at the same time in the first position, while the other pair of opposite sides is treated at the same time in the second position.

Advantageously, both the painting means (in the form of a spray gun for example, not shown) and the rolling and/or brushing means on the roller and/or brush equipment are supported by a corresponding mobile support unit adapted to move said means along the closed cyclic passage during use.

This closed cyclic passage comprises at least one section of the manufactured article 2 travel path which develops along a direction on a slope compared to the movement direction of manufactured article 2, and during which the painting means or brushing and/or roller means is subject to position change relative to article 2.

In particular, in order to apply each layer of paint, the painting means follows a first section along the corresponding cyclic passage, this section being on a slope compared to the article 2 movement direction, a first return section in the direction parallel to the article 2 movement direction, a second section on a slope compared to the article 2 movement direction, and a second return section parallel to the article 2 movement direction.

Therefore the painting means follows an "8" shaped path composed of two forward movement lines and two return lines.

Measuring means (not shown) is positioned corresponding to at least the second painting center, and in particular, both the second and the third painting centers. Said measuring means is the same size as the manufactured articles 2 connected to a control means adapted to enable the delivery of a precise amount of paint according to the measurement performed and a dedicated formula that decides the amount of paint necessary for the final required finish effect.

In particular, the measuring means includes a first photocell that detects a first measurement related to the size of one of the pairs of opposite sides of article 2 and a second photocell that detects the second measurement related to the other pair of opposite sides of article 2.

This double measurement can be carried out by rotating the article 2 by 90° between one measuring operation and the other.

The result of the double measurement is transmitted to said control means, in turn connected to data storage means containing all the information relative to the amount of paint to be used according to the calculated measurements.

In particular data storage means contains a first series of values concerning the amount of paint to be used and a second series of value ranges equal to the sum of the first and second measurement.

Each value of the first series is associated with a value range of the second series, so that after receiving the values of the first and second measurements, the control means checks at which value range the sum of the first and second measurement belong, and refer back to the corresponding value of the amount of paint to be used.

In order to create the corresponding cyclic passage, the mobile support unit (not shown) of the painting means moves preferably along a fixed guide comprising a first and a second portion of guide on a slope compared to the article 2 movement direction, and a third and a fourth portion parallel to the article 2 movement direction.

The same cyclic passage can be created in an alternative manner wherein the mobile support unit of the painting means can move on a guide set at right angles, and in this particular case, set vertically relative to the manufactured article 2 movement direction, and is mounted on another support that moves in a direction parallel to the manufactured article 2 movement direction.

Below is the description of the roller and/or brushing device 6.

This is composed of a frame 13 having two opposite rows of uprights 14, adapted to limit the work area along which the article(s) 2 travel on the center line transported by the overhead conveyor 10.

The equipment 6 includes at least a first mobile support unit for at least the first roller and/or brushing means, for example a first roller 50/brush 51 unit. Preferably, the side surface of roller 50 will be coated with a layer of elastically deformable material, the work face being composed of hollows and peaks especially processed on the surface according to the graphic result required on the manufactured article 2 finish.

Preferably, the equipment 6 has at least a second roller and/or brushing means, for example a second roller/brush unit for simultaneous rolling and/or brushing of the two manufactured articles.

In particular, the equipment 6 has a first set 45 and a second set 46 of two pairs of roller/brush units opposite each other relative to the center line of the work area.

The article 2 rotation unit is positioned between the first and second sets of roller/brush units 45 and 46.

The adjacent roller/brush units of the first and second sets 45 and 46 respectively, are supported by a single corresponding mobile support unit 15 adapted to guide them along the closed cyclic passage comprising a single portion of the manufactured article 2 passage during which the relative position change between roller/brush unit and article 2 is set.

The section develops along a slope compared to the article 2 movement direction.

Advantageously, the uprights 14 are set on a slant to act as a runner guide for corresponding support units 15.

Preferably at least a first roller/brush unit, and in particular each roller/brush unit has its axis at right angles to the direction of the slanting uprights 14.

Each mobile support unit 15 is associated with a carriage 25 pulled along a corresponding upright 14 of the frame 13 by a transmission organ 26, for example a toothed belt, attached to the carriage 25 and driven by a suitable motor 27.

The equipment 6 presents at least a first moving means 28 for moving at least the first roller and/or brushing means at right angles to the article 2 movement direction between an idle position and an operating position.

For each roller/brush unit, said moving means 28 are composed of a linear actuator 29 comprising, for example, a cylinder 32 integral with the mobile support unit 15 and a piston 33 that controls the carriage 30 run at right angles to article 2 travel direction in a guide 31, also integral with the mobile support unit 15.

Each carriage 30 supports a corresponding roller/brush unit mounted with a rotating roller, and a brush mounted in fixed position.

The brush can be easily removed in cases where brushing is to be performed at a different moment from the rolling operation.

Each carriage 30 is also mounted with a roller rotation control motor 34.

Naturally a transmission organ, preferably a toothed belt 35, is mounted between the roller and its drive motor 34. The overhead conveyor system 10 is provided with support organs 16 adapted to support the manufactured articles 2 revolving around an axis basically at right angles to its movement direction, and in this specific case, around a basically vertical axis.

The support organ 16 presents a first plate-shaped positioning element 17 and at least a second element 18, respectively that can be engaged in a selective manner by the first or second guide means 20 and 21 to orient each manufactured article 2 during rolling and/or brushing operations in a first or at least second pre-established angular rotation position, preferably basically rotated at 90° relative to the first pre-established angular position.

The plate-shaped positioning elements 17 and 18 are positioned alongside each other with their surfaces lying flat basically at right angles to each other. The support organ 16 is oriented so that the plate-shaped positioning elements 17 and 18 are oriented one above the other.

The guide means 20 and 21 are also positioned one above the other so that each means corresponds with one or the other of the plate-shaped positioning elements 17 and 18.

The guide means 20 and 21 are moved by a corresponding linear actuator 23 at right angles to the article 2 movement direction, and are provided with a pair of plates 24 facing each other to form a guide runner channel that is only slightly wider than the thickness of the plate-shaped positioning elements 17 and 18.

Each linear actuator 23 comprises, for example, a cylinder 40 attached to the fixed support frame of the mobile support unit 15 and a piston 41 that activates the guide means 20 and 21. As it is known, each end of each roller axis is mounted with two fixed arms destined for two suction means (not shown) for example, suction vents, adapted to remove any paint eliminated during the roller treatment on the manufactured article 2.

The painting method, and with particular reference to the operations that are performed in at least one of the painting centers and in at least one of the brushing and/or roller centers, is apparent from the descriptions and illustrations above, and in particular, the method is composed as follows:

As it travels along the continuous passage in a painting center, the manufactured article 2 is subject to a first measuring operation to calculate the size of a pair of opposite side faces, afterward it is then rotated by 90° with respect to the measurement means, and it is subject to a second measurement to calculate the size of the other pair of opposite side faces.

In the paint center first a paint layer is applied to a pair of opposite side faces of the article according to the first detected measure and a dedicated formula to obtain the desired paint amount for the final required effect.

The article is then rotated by 90° and the other pair of its opposite side faces are painted according to the second detected measure and a dedicated formula to obtain the desired paint amount for the final required effect.

Each spray gun in the forward following section of its cyclic passage performs the painting, from top to bottom or vice versa on the article and in the return following section of its cyclic passage performs the painting, from bottom to top or vice versa on the successive article (if present).

On the other hand, during the forward continuous passage through a roller and/or brushing device, an article, and then the successive article (if present) pass through the first set of two pairs of roller/brush units positioned opposite each other and are simultaneously subject to the rolling and/or brushing treatment in correspondence to the pair of opposite face surfaces each one carried out by a corresponding pair of roller/brush units opposite each other.

The two pairs of roller/brush units opposite each other carry out their function in the following section of the corresponding cyclic passage from top to bottom and in the unloaded return passage, from bottom to top.

After the passage through the first series of roller/brush units the article(s) are rotated by 90° and are conveyed to the second set of two roller/brush units opposite each other to be subjected to a similar rolling and/or brushing treatment corresponding to the other pair of side faces.

During the rolling and/or brushing treatment each mobile support unit 15 moves along the corresponding sloped upright 14, while each carriage 30 moves the corresponding roller/brush unit as needed between the work position and idle position. Still during the brushing and/or rolling treatment through the first set of roller/brush units, the first mobile guides 20 slide to engage the first plate-shaped element 17 of support organ 16 so as to block the lying position of the article(s) with a pair of opposite side surfaces facing the second set of roller/brush units.

In similar manner, during the rolling and/or brushing treatment through the second set of roller/brush units the second mobile guide means 21 slides to engage the second plate-shaped element 17 of support organ 16 so as to block the lying position of the article(s) with the other pair of opposite side faces, facing the second set of roller/brush units.

During the relative movement between each roller/brush unit and the manufactured article, used to slide the roller/brush unit along the total face of the article to be treated, the roller can be activated to roll without or with a sliding action on the article face.

Rolling action without roller sliding on the article face acts so that the work surface of the coating layer adheres to the article face to be decorated, and so that the powder paint previously laid in a uniform manner on the surface to be decorated is picked up by the protruding peaks of the matrix on the roller coating layer leaving an impression that reproduces perfectly the original matrix pattern.

The rolling and sliding action by the roller on the article creates an impression on the face to be decorated that does not reproduce the exact pattern of the matrix, but creates a distorted effect that imitates wood grain and knots.

In particular, with the roller sliding action on the article, raised and recessed effects are obtained that confer the required tactile as well as visual aspect of wood.

This is obtained due to the fact that the roller shifts the last powder paint layer, modifying the thickness before final polymerization.

Last, it should be noted that as more than one baking operations are envisaged to complete paint layer polymerization, and in particular, a first baking treatment to fix the first base coat, a second baking to fix the second paint layer, that is a light coating, and a third and final baking to complete the polymerization of the first layer, second layer and third layer of coating paint, the adhesion between the various layers of paint, and between the first layer and the article's metal surface, is improved considerably.

This occurs because the plurality of baking operations helps co-penetration between the various paint layers, and the penetration of the first paint layer into the porous metal surface of the article.

The third and most external paint layer can penetrate the second paint layer completely and deeply, even into the first paint layer.

In particular, as an example, with a first paint layer having a theoretical thickness of 70 microns, and a second layer and a third layer each having a thickness of 5 microns, after the final baking the second and third paint layers will penetrate the first paint layer to a depth at least equal to 10 microns.

The painting method and application equipment thus obtained can be subject to numerous modifications and variants, all of which falling within the scope of the invention; moreover, all components can be replaced by technically equivalent elements.

The invention claimed is:

1. Powder painting equipment for at least one manufactured article, the equipment comprising:

overhead conveyor means for transporting the manufactured article along a generally horizontal conveyor path, the conveyor means including a support organ supporting the article for rotation about a generally vertical axis, the support organ having first and second flat plates rotationally fixed to the article supported by the organ and extending generally in respective vertical planes at right angles to each other, first application means adjacent the transport path for applying a first layer of powder paint to the article, first guide means at the first application means for engaging the first plate and holding the manufactured article in a predetermined angular position relative to the axis during application of the first layer;

means at a first station downstream of the first application means for fixing said first paint layer, second application means downstream of the first station for applying a second layer of powder paint in a color, tone or properties different from said first paint layer to the article, second guide means at the second application means for engaging the second plate and holding the manufactured article in a predetermined angular position offset by about 90° to the first position relative to the axis during application of the second layer;

means at a second station downstream of the second application means for the final baking of said first and second paint layers, second means downstream of the second application means and including a roller or brush for rolling or brushing the manufactured article to produce a desired decorative effect, a first mobile support unit mounted in each application means and adapted to move the respective application means along a corresponding closed cyclic passage including at least a first following section of said manufactured article during which a relative movement is imposed between said the respective application means and the article, and first mobile means for moving the roller or brush along a corresponding closed passage including the first following section of the manufactured article during which a relative movement is imposed between roller or brush and the manufactured article.

2. The powder painting equipment according to claim 1, further comprising:

means for measuring the size of the manufactured article immediately upstream of the second application means, and control means for supplying a paint amount according to detected measurements and to a dedicated formula to obtain the desired final effect.

3. The powder painting equipment according to claim 1 wherein each support unit moves on a fixed guide comprising a first and second portion of guide sloped in relation to a travel direction of the manufactured article, and a third and fourth portion parallel to the travel direction of the manufactured article.

4. The powder painting equipment according to claim 1 wherein the first mobile support unit moves on a mobile guide positioned at a right angle to a travel direction of the manufactured article and carried in turn by a mobile support unit in a direction parallel to the travel direction of the manufactured article.

5. The powder-painting equipment defined in claim 1 wherein the first and second rolling or brushing means presents an axis at right angles to said sloping direction of said first following section.

6. The powder-painting equipment defined in claim 1 wherein each of said guide means of said first and second positioning elements is driven by a respective linear actuator at right angles to the travel direction of the manufactured article.

7. Powder-painting equipment for rolling or brushing at least one manufactured article to reproduce a desired decorative finish, the equipment comprising:

overhead conveyor means for transporting the manufactured article in a travel direction along a generally horizontal conveyor path, the conveyor means including a support organ supporting the article for rotation about a generally vertical axis, the support organ having first and second flat plates rotationally fixed to the article supported by the organ and extending generally in respective vertical planes nonparallel to each other, a first rolling or brushing means having a roller or brush and mounted on a first mobile support unit movable along a corresponding closed circuit passage having a single following section of the manufactured article during which movement is imposed between said roller or brush and the manufactured article, and a single return section, said following section extending in a direction that slopes in relation to the travel direction of the manufactured article, first guide means at the first rolling or brushing means for engaging the first plate and holding the manufactured article in a predetermined first angular position relative to the axis during application of a first paint layer;

means at a first station downstream of the first application means for fixing said first paint layer, second application means downstream of the first station for applying a second layer of powder paint in a color, tone or properties different from said first paint layer to the article, and second guide means at the second application means for engaging the second plate and holding the manufactured article in a predetermined second angular position angularly offset from the first position relative to the axis during application of the second layer.

8. The powder-painting equipment defined in claim 7 wherein said first and second plates lie in respective planes substantially at a right angle to each other such that the second angular position is angularly offset by about 90° relative to the first angular position.

9. The powder-painting equipment defined in claim 7 wherein said first mobile support unit of said first rolling or brushing means comprises a carriage moved along a corresponding sloping upright of an equipment frame driven by a motor through a transmission.

10. The powder-painting equipment defined in claim 7, further comprising:

at least a first moving means mounted on said first mobile support unit of said first rolling or brushing equipment set at right angles to the travel direction of the manufactured article, between an idle position and operating position.

11. The powder-painting equipment defined in claim 10 wherein said first moving means comprises an actuator for the linear control of a carriage sliding on a guide at right angles to the travel direction of the manufactured article, said carriage supporting said first rolling or brushing means and a rotation control motor for said first rolling means.

* * * * *